US008522591B2

(12) United States Patent
Blecher

(10) Patent No.: US 8,522,591 B2
(45) Date of Patent: Sep. 3, 2013

(54) DEVICE FOR CHANGING/TRANSPORTING ROLLS

(75) Inventor: Gerhard Blecher, Erndtebrück (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 791 days.

(21) Appl. No.: 12/087,192

(22) PCT Filed: Jan. 9, 2007

(86) PCT No.: PCT/EP2007/000112

§ 371 (c)(1),
(2), (4) Date: Sep. 2, 2008

(87) PCT Pub. No.: WO2007/080088

PCT Pub. Date: Jul. 19, 2007

(65) Prior Publication Data

US 2009/0038363 A1 Feb. 12, 2009

(30) Foreign Application Priority Data

Jan. 9, 2006 (DE) ..... 10 2006 001 316
Jul. 5, 2006 (DE) ..... 10 2006 030 934

(51) Int. Cl.
*B21B 31/08* (2006.01)

(52) U.S. Cl.
USPC ..... 72/239; 72/446

(58) Field of Classification Search
USPC ..... 72/238, 239, 237, 419, 446; 164/441, 164/442
See application file for complete search history.

(56) References Cited

U.S. PATENT DOCUMENTS

| | | | | |
|---|---|---|---|---|
| 3,842,639 | A | 10/1974 | Petros | |
| 6,425,278 | B1 | 7/2002 | Aratani et al. | |
| 6,763,565 | B2 * | 7/2004 | Mukaigawa et al. | 29/426.1 |
| 7,363,793 | B2 * | 4/2008 | Benner | 72/238 |
| 2002/0078728 | A1 | 6/2002 | Mukaigawa et al. | |

FOREIGN PATENT DOCUMENTS

| | | |
|---|---|---|
| DE | 18 04 282 | 6/1969 |
| DE | 43 21 663 | 1/1995 |
| JP | 60 196211 | 10/1985 |
| WO | 03/015949 | 2/2003 |
| WO | 03/099479 | 12/2003 |
| WO | 2004/039512 | 5/2004 |
| WO | 2004/050271 | 6/2004 |
| WO | 2005/089972 | 9/2005 |

* cited by examiner

*Primary Examiner* — Debra Sullivan
(74) *Attorney, Agent, or Firm* — Lucas & Mercanti, LLP; Klaus P. Stoffel

(57) ABSTRACT

The invention relates to a method for changing/transporting a fire roll set (7, 8) and a second roll set (22) on a transversal displacement platform (23) in the region of a roll stand (4) in a roll hall, in or counter to the direction of rolling. During the changing/transporting of the first and the second roll set (7, 8, 22) by the transversal displacement platform (23), a roll changing hole (10) is completely transversed/covered. The invention also relates to a device for carrying out said method.

4 Claims, 5 Drawing Sheets

1
2
3
4
5
6
7
8
10
11
12
16
17
18
19
20
21

Fig. 2
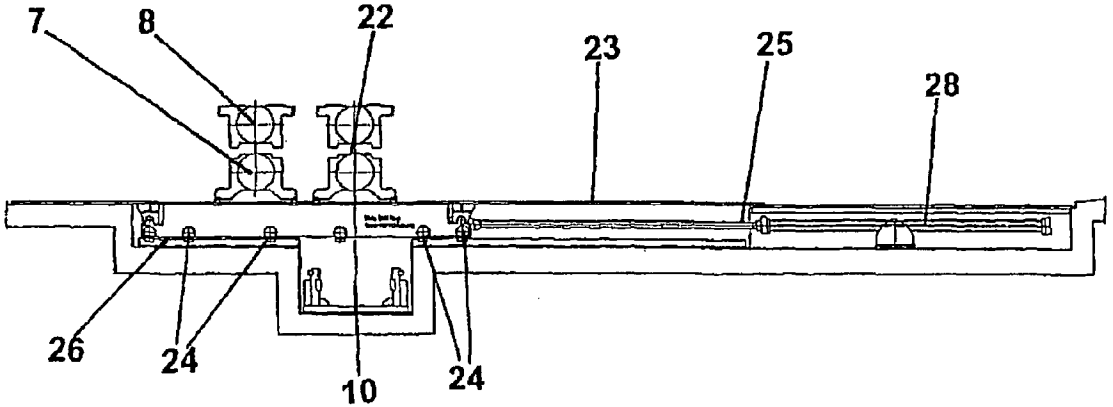
Fig. 2b
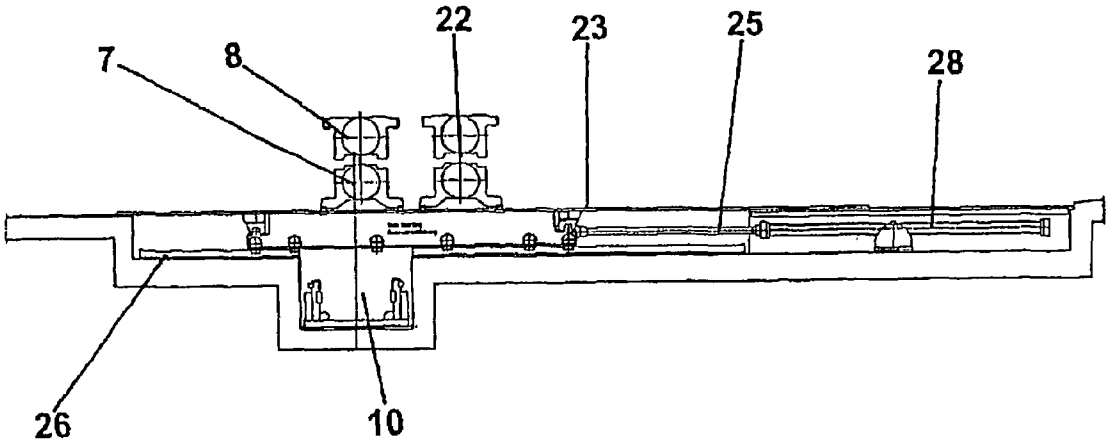
Fig. 2a

DEVICE FOR CHANGING/TRANSPORTING ROLLS

BACKGROUND OF THE INVENTION

The invention concerns a method and a device in the form of a shift platform for changing/transporting a first set of rolls and a second set of rolls on the shift platform.

WO 03/099 479 A1 describes a device for changing pairs of work rolls and/or pairs of back-up rolls in rolling stands, in which the back-up rolls and the work rolls are guided in the housing frame in respective chocks that can be lifted or lowered, and the pair of work rolls can be moved out by a linear actuator while being supported on the chocks. The pair of back-up rolls can be moved in or out by means of a lower back-up roll supported on a track and wheels and a roll-changing frame, which supports the upper back-up roll and is supported on the lower back-up roll. In this regard, the pair of work rolls can be coupled on the drive side of the rolling stand with a hydraulic piston-cylinder actuator that is dimensioned in its stroke length for the removal or installation distance and can be uncoupled when it has been withdrawn the required distance. Furthermore, a roll-changing frame, which has been moved in at a height level between the back-up rolls, can be coupled to the same piston-cylinder actuator, and, when the upper back-up roll and the roll-changing frame are supported on the lower back-up roll, the pair of back-up rolls can be moved out or moved back in. The cited document also describes a corresponding method.

Wo 2004/039 512 A1 discloses a tractor, with which the sets of rolls are pulled into a roll workshop (RW) and moved back again. The tractor is moved by gear wheels of the tractor that engage racks.

DE 43 21 663 A1 describes a rolling mill with support plates, which are arranged on the operating side of the rolling stands, are supported on carriages, can be displaced transversely to the roll axes, and are equipped with at least two pairs of rails, which are arranged side by side for receiving sets of work rolls supported on rollers, and with roll-changing pits arranged in front of each rolling stand, with the bottom of each roll-changing pit being equipped with runout rails for sets of back-up rolls. In this regard, the pits are covered between the stands and the support plates with cover plates that extend the length of the pit, which can be fixed in their initial position and can be swiveled out of this initial position to change the back-up rolls, and each cover plate is provided with a respective support plate for moving out sets of work rolls and transferring them to one of the pairs of tracks of the respective support plates assigned to it.

WO 03/015 949 A1 describes an apparatus for changing work rolls and back-up rolls of a strip rolling mill, in which a roll-changing carriage, which can be displaced transversely to the rolling stand and holds the old sets of rolls that have been removed, makes it possible to replace the old sets of rolls with new sets of rolls. The apparatus consists of a stationary changing cylinder mounted at the floor level of the mill, whose piston rod can move in and out transversely to the rolling stand, and of an extraction carriage connected to the forward end of said piston rod and movable on said roll-changing carriage, said extraction carriage being connectable with said roll-changing carriage such that said extraction carriage and said roll-changing carriage are movable together by said changing cylinder transversely to the longitudinal path of said strip mill. In addition, a side shift cylinder that is independent of the roll-changing carriage can move a side shift table, which is installed in said roll-changing carriage, transversely to the direction of movement of the roll-changing carriage, in order to move the sets of rolls to be changed in or out of a changing position which is aligned with the center of the rolling stand.

WO 2005/089 972 A1 describes a method for changing sets of rolls in rolling stands of a mill train with several rolling stands, each of which has back-up rolls and work rolls, by supporting them on each other and then moving them out in the axial direction of a set of work rolls or a set of back-up rolls on the operating side into a roll workshop and then moving new sets of rolls back and mounting them. During this operation, the sets of worn work rolls transported by a number of separate side shift carriages that corresponds to the number of rolling stands on the operating side are successively moved by a single locomotive on a single connecting track to the roll workshop, and from there the new sets of work rolls are driven back and at changing intervals are set down on the respective side shift carriages between the rolling stands, and after clearance of the operating side by the side shift carriages, after each dismounted worn set of work rolls, the worn back-up rolls are moved out, moved to the roll workshop by crane, serviced, transported back and remounted in the assigned rolling stands. The cited document also describes a device for carrying out this method.

SUMMARY OF THE INVENTION

The objective of the invention is to propose a flexible method for changing/transporting the sets of rolls in the mill hall with little expense with respect to the equipment. A further objective of the invention is the development of a device for carrying out the method of the invention.

In accordance with the invention, the side shift platform is designed to hold both a dismounted set of work rolls and a new set of work rolls arranged side by side and parallel. In addition, the side shift platform is designed in such a way in its length and with its track rollers that, on the one hand, during the extraction of the used set of work rolls from the rolling stand, it bridges the roll-changing pit and is supported on the rails on both sides of the roll-changing pit, and on the other hand, during its lateral displacement over the roll-changing pit to free the pit, it can be supported on the rails only on one side of the roll-changing pit.

Further embodiments of the method are described in the associated dependent claims.

The invention also concerns a device for carrying out the method of the invention. In accordance with the invention, the device is designed as a shift platform, which is designed to ride on two parallel rails, in order to receive both the first, used set of work rolls and the second, new set of work rolls. As a result of the installation of track rails on both sides of the roll-changing pit, the shift platform is precisely guided and horizontally supported even after the roll-changing pit has been bridged/covered.

Further embodiments of the device are described in the associated dependent claims.

The apparatus for changing the work rolls is located on the operating side of the rolling mill. The tasks of the work roll-changing apparatus consist in pulling used sets of work rolls out of the rolling stand and then, for example, transporting them as far as the roll workshop and in transporting the freshly ground sets of work rolls from the roll workshop back to the rolling stand.

The side shifting of the sets of rolls takes place in the mill hall in the area of the roll-changing pit. The purpose of the side shifting is to shift the used set of work rolls that has been pulled out of the rolling stand sufficiently far from the pass line/center of the roll-changing pit that the new set of work rolls can be positioned in the pass line.

The shift platform consists of a steel structure with the same slide bars as on the platforms. The shift platform is designed in such a way that two sets of work rolls, i.e., one used set of rolls and one new set of rolls, can be positioned on it. A hydraulic cylinder moves the shift platform into the desired position. The shift platform itself is rail-mounted and in a preferred embodiment runs on a total of twelve track rollers, each of which is supported in double-row thrust bearings.

In the changing carriage, racks with mounting material and feather keys are no longer needed. The complicated work involved in mounting the racks as well as the entire centering of the changing carriage are eliminated.

BRIEF DESCRITION OF THE DRAWINGS

A specific embodiment of the invention is explained in greater detail below with reference to the highly schematic drawings.

FIG. 2 shows detail drawings of the shift platform in the mill hall.

DETAILED DESCRIPTION OF THE INVENTION

Figures 1, 1A, 1B:
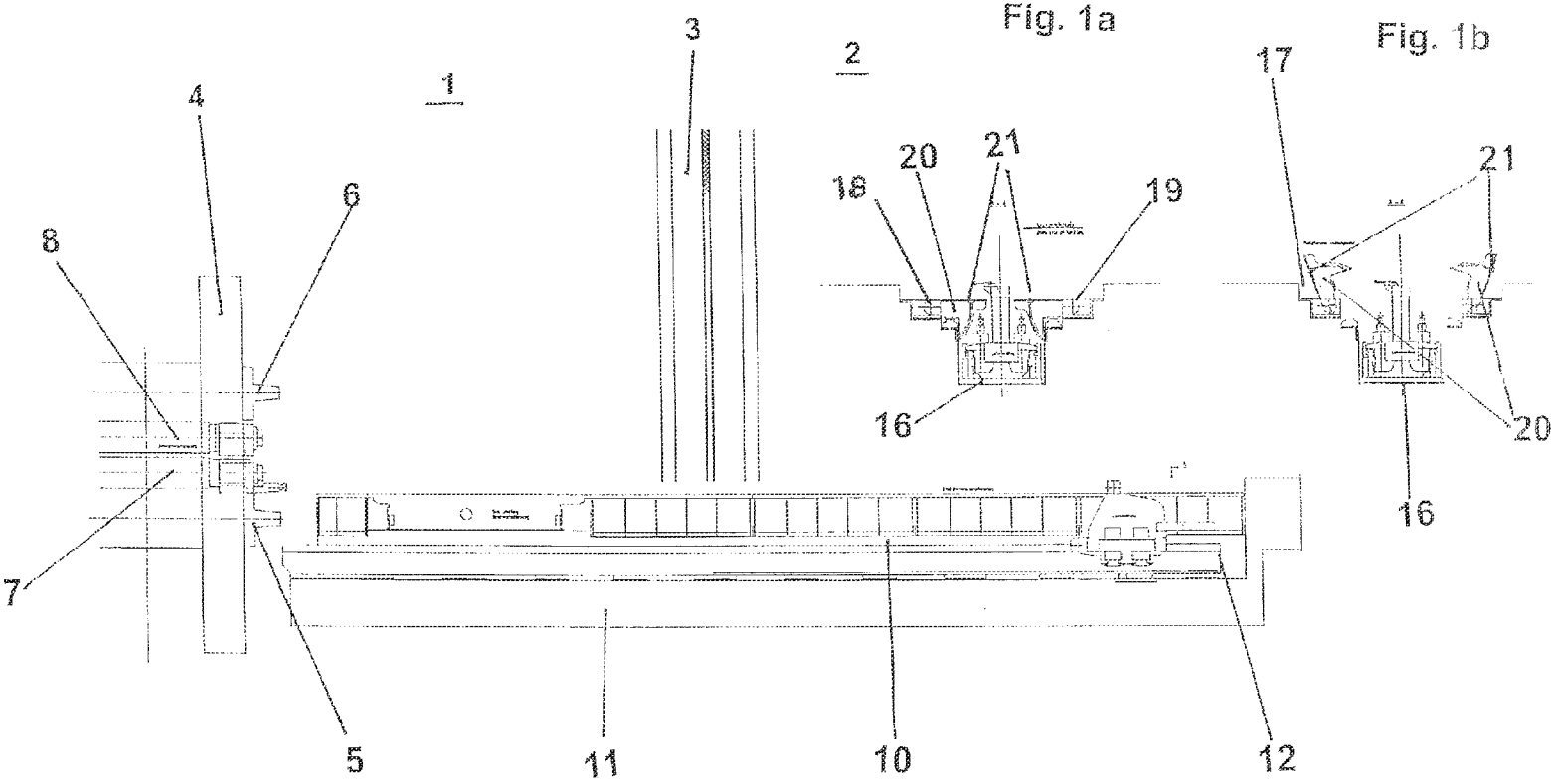
FIG. 1 is a cross section of a mill hall with a rolling stand and a roll workshop separated from the mill hall by a wall.

FIG. 1 shows a mill hall 1 on the left side in the rolling direction and a roll workshop 2 on the right side. The two areas are separated by a wall 3. A lower back-up roll 5, an upper back-up roll 6, a lower work roll 7 and an upper work roll 8 are mounted in a rolling stand 4. A locomotive 9 is used to transport rolls from the rolling stand 4 in the mill hall 2 to the roll workshop 2, for example, in order to regrind the rolls. The locomotive 9 is located in a roll-changing pit 10, which connects the mill hall 1 and the roll workshop 2. All of the equipment, such as rails, etc., is installed on a foundation or several foundations 11. The locomotive 9 can thus be moved from a waiting position 12 at the right end of the roll-changing pit 10 to the rolling stand 4. FIGS. 1*a* and 1*b* are cross-sectional views that show how the locomotive 9 is installed in the roll-changing pit 10. As the drawings show, the roll-changing pit 10 is divided into a lower, narrow region 16 and an upper, wide region 17. The lower, narrow region 16 is only slightly wider than the locomotive 9. The upper, wide region 17 has platforms 20 at its two edges 18, 19. The platforms 20 are moved downward when a set of work rolls 7, 8 is being removed or transported. The upper sides of the platforms 20 have guide rails 21, on which the set of work rolls 7, 8 can be moved. The platforms 20 are separated by a distance that allows a coupling device 14 mounted on the upper side 13 of the locomotive 9 to pass through. To transport the set of back-up rolls 5, 6, which have larger diameters, the platforms 20 are opened upward and thus widened to allow the rolls to pass through.

The dismounted set of work rolls 7, 8 is replaced by a new set of work rolls. This is done as quickly as possible to minimize rolling stand downtime. Therefore, the invention provides that the new set of work rolls is already prepared for mounting in the mill hall 1. Apparatus for accomplishing this is shown in FIG. 2. This apparatus, which is known as side-shifting apparatus, makes it possible for the dismounted set of work rolls, which consists of the work rolls 7, 8, and a new set of work rolls 22 to be arranged side by side and parallel to each other on a side shift platform 23. The shift platform 23 is a steel structure. In FIG. 2*a*, the dismounted set of work rolls 7, 8 is positioned on the left side. In this position, the shift platform 23 rests on the right and left edges of the roll-changing pit 10. The shifting is produced, for example, by a hydraulic cylinder 28 with a connecting rod 25. The shift platform 23 is moved on rails 26 by several track rollers 24. FIG. 2*b* shows the position of the shift platform 23 in which the new set of work rolls 22 can be pushed into the rolling stand 4.

Figure 3:
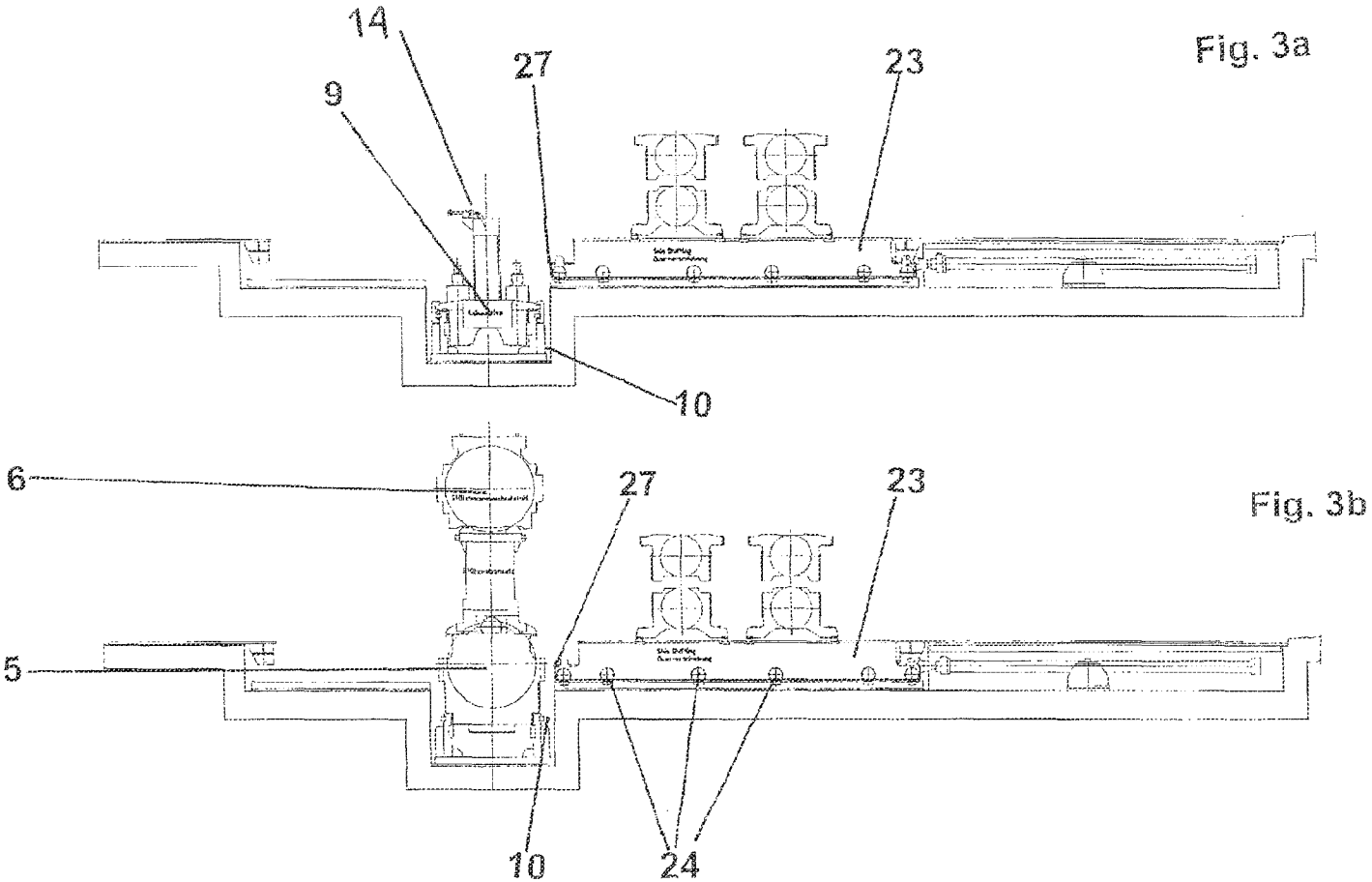
FIG. 3 shows the shift platform with the pit open.

In order for the locomotive 9 then to be able to pull the set of back-up rolls, which consists of back-up rolls 5, 6, out of the rolling stand 4, the roll-changing pit 10 must be cleared. As was explained earlier, this is accomplished by raising the platforms 20. In addition, the shift platform 23 is moved far enough to the right (see FIGS. 3*a* and 3*b*) that the left edge 27 of the side shift platform 23 completely clears the roll-changing pit 10. Due to the design of the shift platform 23 with several track rollers 24 and a suitable length, in the transition region it can be supported only on one side.

Figure 4:
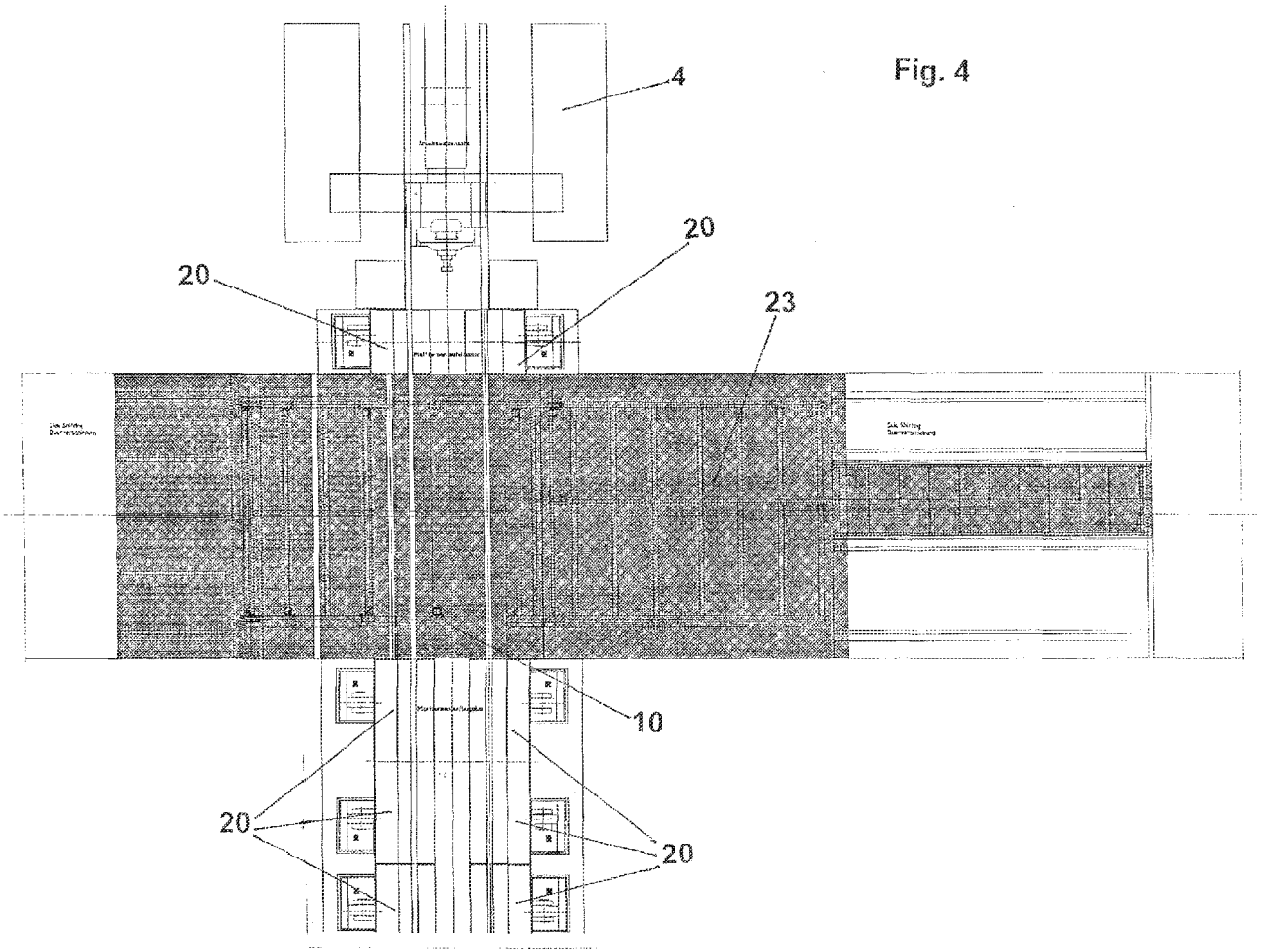
FIG. 4 is a top view of the shift platform during extraction of the set of work rolls.
Figure 5:
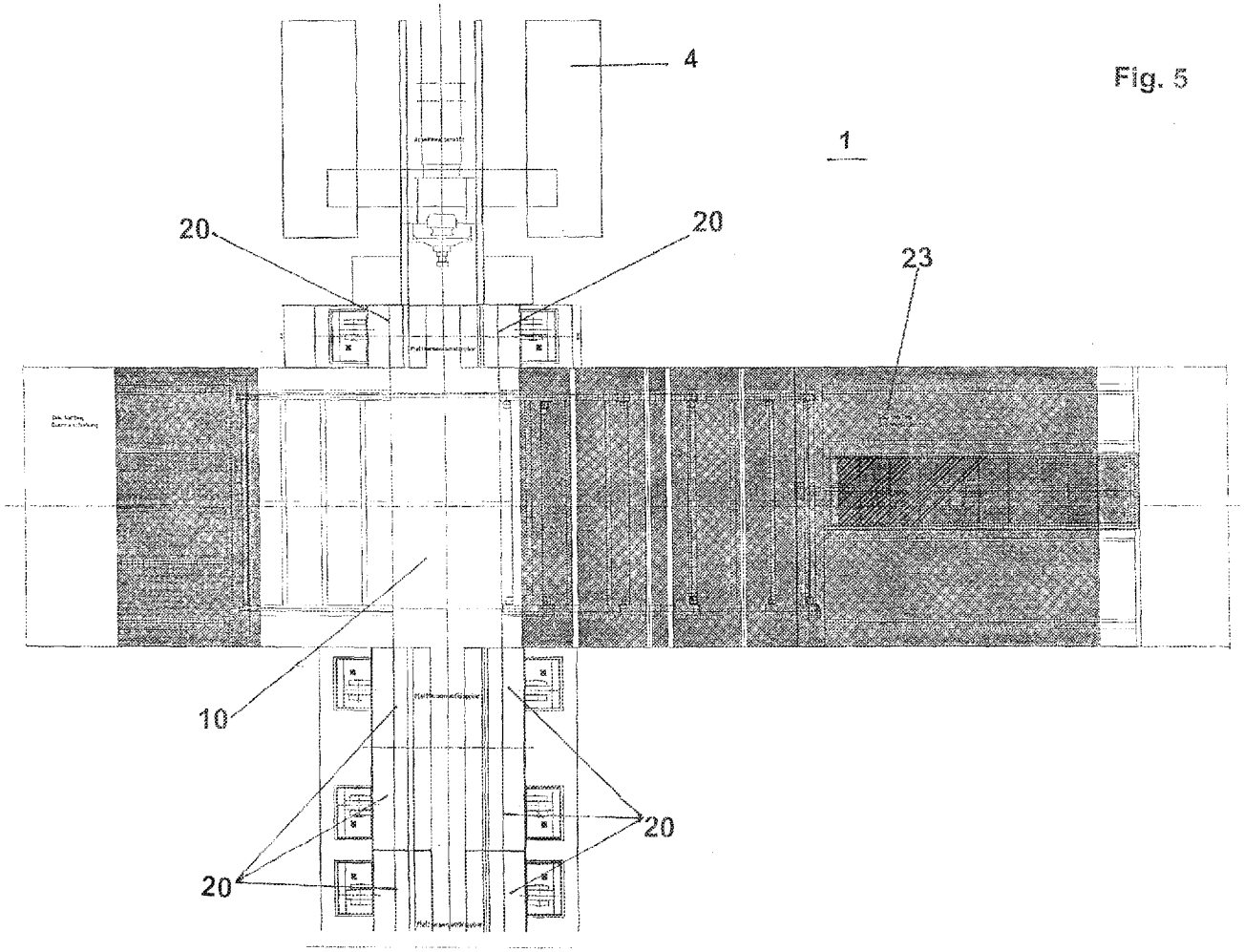
FIG. 5 is a top view of the shift platform in the correct position for extracting a set of back-up rolls.

FIG. 4 shows a top view of the position in which the shift platform 23 covers the roll-changing pit 10. FIG. 5 shows the shift platform 23 in the position in which the roll-changing pit 10 is cleared for the extraction of the set of back-up rolls 5, 6. To accomplish this, the platforms 20 with the rails still have to be raised or opened upward.

LIST OF REFERENCE NUMBERS

1 mill hall
2 roll workshop
3 wall
4 rolling stand
5 lower back-up roll
6 upper back-up roll
7 lower work roll
8 upper work roll
9 locomotive
10 roll-changing pit
11 foundation
12 waiting position
13 upper side
14 coupling device
15 connecting rod
16 narrow region
17 wide region
18 edge
19 edge
20 platform
21 guide rail
22 set of work rolls
23 shift platform
24 track rollers
25 connecting rod
26 rail
27 left edge
28 hydraulic cylinder

The invention claimed is:

1. A device for changing a set of work rolls (7, 8, 22) in the area of a rolling stand (4) in a mill hall (1) having a roll-changing pit (10) and a side shift platform (23), where the side shift platform (23) has several track rollers (24) with which the side shift platform (23) can be moved in the direction of rolling or in the opposite direction by means of a hydraulic cylinder (28) over parallel rails (26) arranged on both sides of the roll-changing pit (10), wherein the side shift platform (23) is a simple bridge having a length substantially greater than the width of the roll-changing pit and designed to hold both a dismounted set of work rolls (7, 8) and a new set of work rolls (22) arranged side by side and parallel to one another; where the side shift platform (23) is designed in such a way in its length and with its track rollers (24) that, on the one hand, during the extraction of the used set of work rolls from the rolling stand (4), it bridges the roll-changing pit and is supported on the rails (26) on both sides of the roll-changing pit (10), and, on the other hand, during its lateral displacement over the roll-changing pit (10) to free the pit, it can be supported on the rails (26) only on one side of the roll-changing pit (10).

2. A device in accordance with claim 1, wherein the side shift platform (23) is designed to ride on two parallel rails (26).

3. A device in accordance with claim 2, wherein the side shift platform (23) is constructed in two rows with six track rollers (24) each.

4. A device in accordance with claim 1, wherein the shift platform (23) is constructed as a steel structure.

* * * * *

UNITED STATES PATENT AND TRADEMARK OFFICE

CERTIFICATE OF CORRECTION

PATENT NO. : 8,522,591 B2
APPLICATION NO. : 12/087192
DATED : September 3, 2013
INVENTOR(S) : Gerhard Blecher It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 950 days.

Signed and Sealed this
Fifteenth Day of September, 2015

Michelle K. Lee

Michelle K. Lee
*Director of the United States Patent and Trademark Office*